US007165688B2

(12) United States Patent
Cameron

(10) Patent No.: US 7,165,688 B2
(45) Date of Patent: Jan. 23, 2007

(54) RETRACTABLE HANGING APPARATUS

(76) Inventor: Richard Cameron, 12992 N. Desert Flora, Marana, AZ (US) 85663

( * ) Notice: Subject to any disclaimer, the term of this patent is extended or adjusted under 35 U.S.C. 154(b) by 109 days.

(21) Appl. No.: 10/895,531

(22) Filed: Jul. 21, 2004

(65) Prior Publication Data

US 2006/0016773 A1 Jan. 26, 2006

(51) Int. Cl.
*B65H 75/30* (2006.01)
*A47H 1/02* (2006.01)

(52) U.S. Cl. ..... 211/105.1; 160/301; 242/385.1

(58) Field of Classification Search ..... 211/105.1; 248/343; 242/385.1; 160/300, 301
See application file for complete search history.

(56) References Cited

U.S. PATENT DOCUMENTS

| | | | | | |
|---|---|---|---|---|---|
| 2,119,408 | A | * | 5/1938 | Wilson | 160/296 |
| 3,430,885 | A | * | 3/1969 | Holmberg | 242/383.5 |
| 3,528,624 | A | * | 9/1970 | Tamarin | 242/385.1 |
| 4,122,559 | A | | 10/1978 | Kelly | |
| 4,252,242 | A | | 2/1981 | Tudor | |
| 4,319,421 | A | * | 3/1982 | Diamond | 40/617 |
| 4,326,637 | A | | 4/1982 | James | |
| 4,398,585 | A | * | 8/1983 | Marlow | 160/23.1 |
| 4,778,089 | A | | 10/1988 | White | |
| 4,819,812 | A | | 4/1989 | Demarest | |
| 4,856,661 | A | | 8/1989 | Guillen | |
| 4,884,618 | A | * | 12/1989 | Steeves | 160/321 |
| 5,205,386 | A | * | 4/1993 | Goodman et al. | 192/46 |
| 5,226,569 | A | | 7/1993 | Watjer | |
| 5,579,965 | A | | 12/1996 | Turner | |
| 5,699,641 | A | * | 12/1997 | Tinen et al. | 52/506.07 |
| 5,702,010 | A | | 12/1997 | Liang | |
| 5,706,876 | A | * | 1/1998 | Lysyj | 160/84.05 |
| 5,732,419 | A | | 3/1998 | Feist | |
| 5,820,205 | A | | 10/1998 | Ammons | |
| 5,853,040 | A | * | 12/1998 | Benthin | 160/299 |
| 6,047,759 | A | * | 4/2000 | Lysyj | 160/84.04 |
| 6,315,357 | B1 | | 11/2001 | Johnston | |
| 6,327,803 | B1 | * | 12/2001 | Ruderman | 40/601 |
| 6,439,492 | B1 | * | 8/2002 | Leiggi | 242/379 |
| 6,484,991 | B1 | | 11/2002 | Sher | |
| RE38,463 | E | * | 3/2004 | Anderson et al. | 248/329 |
| 2002/0113186 | A1 | | 8/2002 | Sher | |
| 2005/0087309 | A1 | * | 4/2005 | Nien et al. | 160/120 |

FOREIGN PATENT DOCUMENTS

| | | | |
|---|---|---|---|
| EP | 0257924 | B1 | 8/1991 |
| WO | WO 03/013322 | A1 | 2/2003 |

* cited by examiner

*Primary Examiner*—Richard E. Chilcot, Jr.
*Assistant Examiner*—Jared W. Newton
(74) *Attorney, Agent, or Firm*—Gavin J. Milczarek-Desai; Quarles & Brady Streich Lang

(57) ABSTRACT

A retractable hanging apparatus that includes an engagement structure, such as a bar, upon which an article is hung or secured, with the engagement structure being suspended by one or more lines that are attached to a spring-biased roller assembly rotatably mounted between two brackets. The roller assembly may be mounted to brackets alone or disposed inside a housing structure. The lines are secured to a roller assembly so that the article may be lowered to a particular height or may, through a short but gentle pull of the engagement means, be elevated as desired. A braking system for preventing sudden retraction of the lines is also described.

6 Claims, 2 Drawing Sheets

RETRACTABLE HANGING APPARATUS

BACKGROUND

1. Field of the Invention

The invention relates in general to the field of lifting mechanisms and more particularly to an apparatus that includes one or more lines that are connected to a spring-biased roller assembly and is especially useful for hanging items such as clothing and the like.

2. Description of the Related Art

The general concept of a "retractable hanger" has been used for many years, mainly for indoor closet and vehicle applications. For example, U.S. Pat. No. 6,315,357 by Johnston describes a retractable garment hanger assembly (for an automobile) that pulls down via "lines" from its mount when it is urged to do so by a user or by hanging clothing upon a bar portion of the structure. When the downward force is removed, the "bar" then retracts into the mounting member.

However, the lines holding the bar on Johnston's invention are constantly urged upward due to a biasing spring. Thus, when the weight being hung upon the bar is removed, a sudden "snapping" action can occur, which potentially can result in a user being pinched or otherwise injured.

Spring-biased roller assemblies (similar to those used in common "roller blinds" for windows) have also been used to provide or hang shower curtains. For example, U.S. Pat. No. 4,122,559 discloses a retractable shower screen unit. The unit basically includes a roller blind of woven glass fiber material housed in an elongate extruded plastics material casing. Two freely rotatable water absorbent sponge rollers are also housed in the casing and the screen passes therebetween.

While the aforementioned inventions have provided suitable function for their intended purpose, none are believed to provide an apparatus that can hang a variety of articles and that does not "snap" to a retracted position unexpectedly. Therefore, in view of the above, it would be desirable to have a retractable hanging apparatus that is simple and durable, that can be used with a variety of lines, and that can be secured to a ceiling or housed out-of-sight in a sub-ceiling.

SUMMARY OF THE INVENTION

The invention relates to a method of hanging articles and a retractable hanging apparatus that mounts to a wall or ceiling. The structure of the hanger includes a engagement means (for example, a bar) upon which an article (e.g., clothing) is hung or secured. The engagement means is suspended by one or more "lines" that are attached to a spring-biased roller assembly that is mounted between two bracket means alone or bracket means disposed inside a housing structure. The "lines" are secured to a roller assembly so that the article may be lowered to a particular height or may, through a short but gentle pull of the engagement means, be elevated as desired.

Preferably, the apparatus of the invention includes a locking or braking systems for the spring-biased roller assembly that reduces the tendency for the assembly to unexpectedly "snap" to a retracted position. Also, the invention preferably includes alignment pads disposed to frictionally engage the line or lines attached to the roller assembly in order to keep the winding motion orderly (i.e., in a particular place on the roller) and to prevent line entanglement with other roller assembly components.

Also preferably, the engagement means includes hangers, hoops, clamps, bars and other structures (such as a hamper or bag) useful for securing or hanging an article to the invention. Thus, depending upon the engagement means utilized, a variety of items may be displayed, hung, or raised, such as, but not limited to, clothing, signage, decorations, and the like.

In a particularly preferred embodiment of the invention, the roller assembly includes a braking mechanism that includes an arm having one or more protrusions at a first end and a hole at a second end, wherein said arm to pivotally attached to said end at the hole and is held in a unengaged position by a magnet disposed upon the end of the roller assembly; and a cog arrangement disposed upon the bracket, wherein centrifugal force swings the arm free of the magnet such that the protrusions engage a cog of the cog arrangement disposed upon the bracket, thereby braking radial acceleration of the roller assembly.

Thus, in view of the disclosure herein, a new and improved retractable hanging apparatus is provided. Moreover, a new and improved article-hanging method is provided. The method involves providing a retractable hanging apparatus that includes a pair of mounting bracket means, a spring-biased roller assembly mounted for rotation about a longitudinal axis on the pair of mounting brackets means, at least one line connected in spooling arrangement with the roller assembly, and an engagement means for engaging an article disposed at the second end of the line; hanging or securing the article to the engagement means of the apparatus; and raising the article by applying a pulling force to the line or engagement means.

Various other purposes and advantages of the invention will become clear from its description in the specification that follows. Therefore, to the accomplishment of the objectives described above, this invention includes the features hereinafter fully described in the detailed description of the preferred embodiments, and particularly pointed out in the claims. However, such description discloses only some of the various ways in which the invention may be practiced.

DETAILED DESCRIPTION OF THE PREFERRED EMBODIMENTS

The invention relates to a retractable hanging apparatus that mounts to a wall or ceiling. The structure of the hanger includes a engagement means (for example, a bar) upon which an article (e.g., clothing) is hung or secured. The engagement means is suspended by one or more "lines" that are attached to a spring-biased roller assembly that is mounted between two bracket means alone or bracket means disposed inside a housing structure. The "lines" are secured to a roller assembly so that the article may be lowered to a particular height or may, through a short but gentle pull of the engagement means, be elevated as desired.

Figure 1:
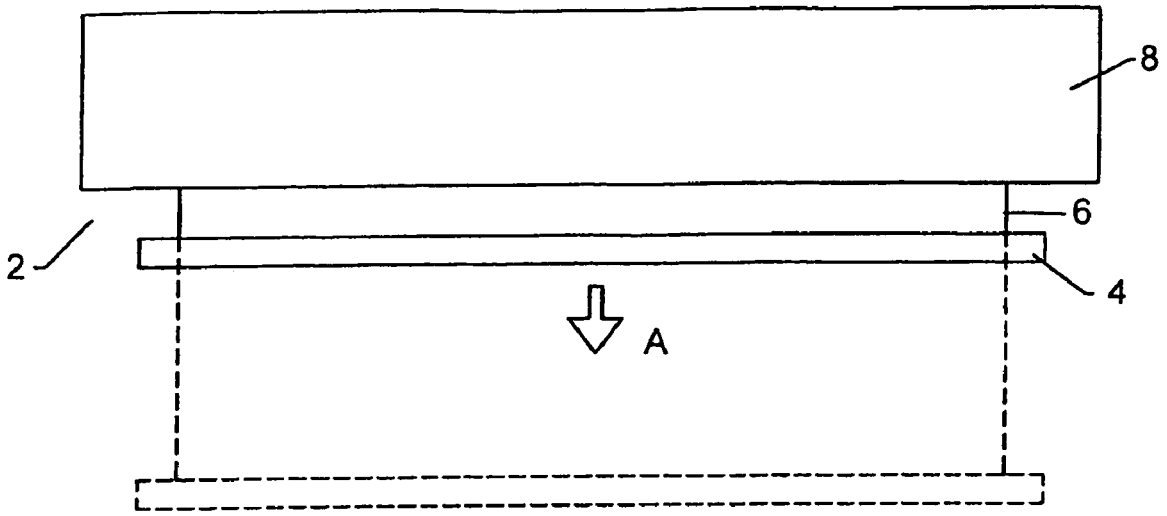
FIG. 1 is a front elevational view of a first embodiment of the invention.

Turning to FIG. 1, a front elevational view of a first embodiment of the invention is shown. The retractable hanging apparatus 2 features an engagement means (in this case, bar 4) that is suspended by lines 6. Lines 6 are wound around a spring-biased roller assembly (see FIG. 2) contained within a housing 8. As is the case with a common roller blind, the invention functions in that user may secure or suspend an article (not shown) from bar 4 and then locate the article to a desired height through the application of pulling force. Thus, as indicated by arrow A and phantom line, a user may pull down on the bar 4 to lower it. Conversely, the bar 4 may be raised by giving it a quick tug. Depending upon the line material (e.g., monofilament line, nylon rope, cables, twine, or fibers) and rating of the roller assembly utilized (e.g., light or heavy duty), a user may hang items that comprise a large range of weight.

Figure 2:
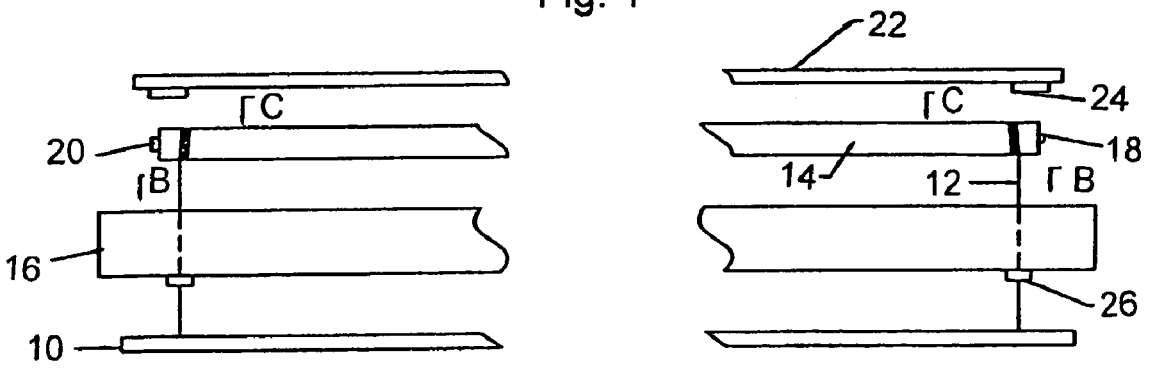
FIG. 2 is a schematic, front elevational, and partially exploded view of a second embodiment.

A partially exploded view of a second embodiment of the invention is shown in FIG. 2. Here, bar 10 is suspended by lines 12 that are attached to and wound around roller assembly 14. Roller assembly 14 may be disposed within housing 16 as indicated by arrows B by placing pin 18 and tab 20 into appropriate mounting brackets or slots (see FIG. 3). Of course, the roller assembly 14 may also simply be mounted between two suitable brackets directly to a ceiling or wall without the housing 16, if desired. While not limited to any particular shape or material, the housing 16 is preferably manufactured in the form of a box out of lightweight plastic or wood. However, metal or other lightweight material may also be used.

As indicated by arrows C, a cover 22 may be disposed atop the housing 16. The cover 22 preferably features alignment pads 24, the purpose of which is to keep lines 12 in place upon the roller 14 such that entanglement with pin 18 or tab 20 is prevented. However, the alignment pads 24 may be disposed upon a surface of the interior of the housing other than the cover or upon the ceiling itself if a housing is not used (not shown). Also preferably, cushions 26 are disposed at the bottom of housing 16 where each line 12 passes through so that noise may be minimized upon full retraction of bar 10.

Figure 3:
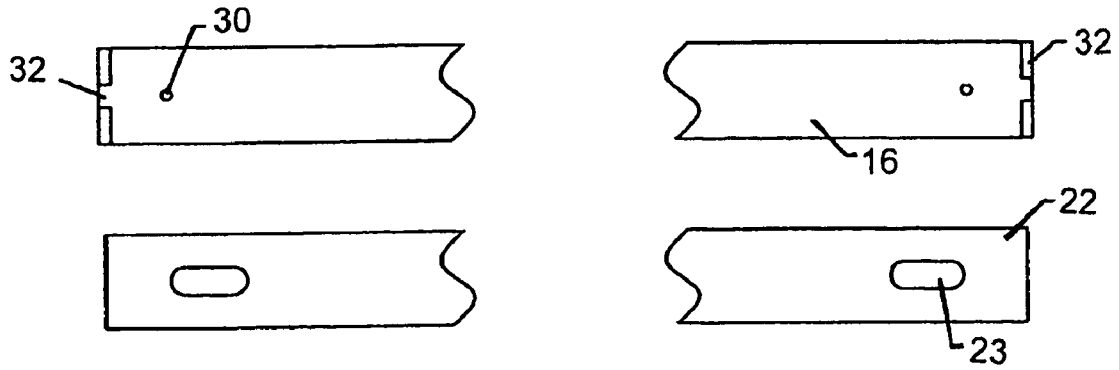
FIG. 3 is a schematic top view of the housing component of FIG. 2 (shown with the roller assembly removed) and the cover.

FIG. 3 illustrates in top view the housing component 16 and the cover 22 of FIG. 2 (shown with the roller assembly removed). In this view, the apertures 30 through which lines 12 pass and mounting brackets 32 are more clearly seen. Moreover, mounting slots 23 disposed within cover 22 may be used to mount the housing 16 to a wall or ceiling.

Figure 4:
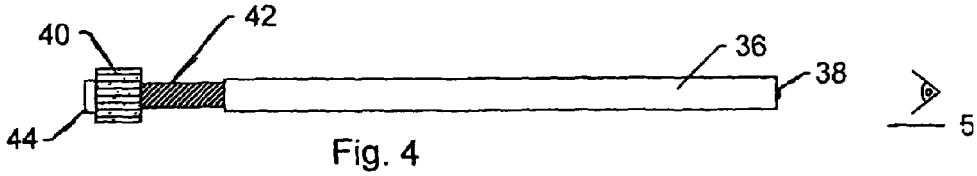
FIG. 4 is a front elevational, partially exploded view of a roller assembly of the invention.

Turning to FIG. 4, a partially exploded view of a roller assembly of the invention is shown. The roller assembly 36 is of the type commonly used in window roller blinds. Thus, the roller assembly 36 include a pin flange 38 at a first end and a lockable bearing flange 40 at the second end. The bearing flange 40 has a spring 42 (e.g., a tension, torsion, or compression spring) connected to its inner end and a tab 44 disposed upon it outer end. As would be known to one skilled in the art, the winding of the spring 42 produces the rotational force needed to move the assembly 36 (and retract anything attached thereto).

Figure 5:
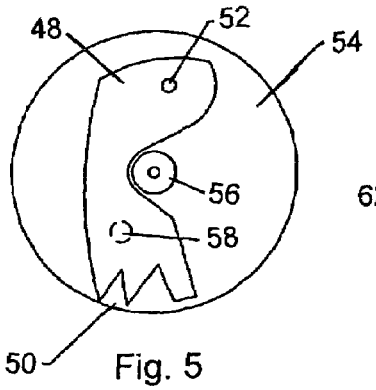
FIG. 5 is an enlarged, side elevational view of a braking mechanism of the invention taken from the direction indicated by arrow 5 in FIG. 4.

FIG. 5 is an enlarged, side elevational view of a braking mechanism of the invention taken from the direction indicated by arrow 5 in FIG. 4. An arm 48 having one or more protrusions (in this case, teeth 50) is attached to by pivot 52 to the outer surface 54 of pin flange 56. Although not shown in the figures, the protrusion also may be a tab, serration, or squared end (such that a corner engages another surface). Magnet 58 keeps arm 48 in an unengaged position during normal "down pull" rotation of the roller bar assembly.

Figure 6:
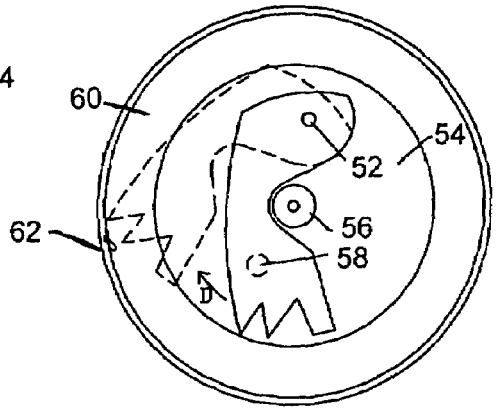
FIG. 6 illustrates the braking mechanism of FIG. 5 in both an unengaged and engaged (shown in phantom line) position.

Thus, FIG. 6 illustrates how the braking mechanism of FIG. 5 engages (shown in phantom line) a "cog" or roughened surface 60 provided within a bracket 62. As indicated by arrow D, the arm 48 is released by magnet 58 and swings out during abrupt rotation, such as during the accidental release of the bar.

Figure 7:
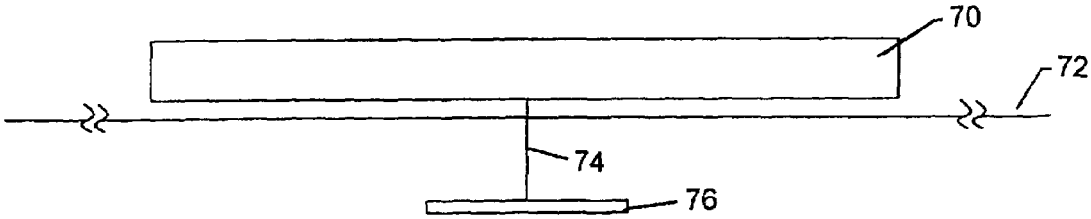
FIG. 7. is a front elevational view of a third embodiment of the invention.
Figure 8:
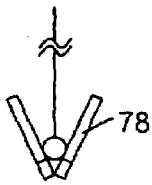
FIGS. 8–11 illustrated alternative engagement means according to the invention.
Figure 9:
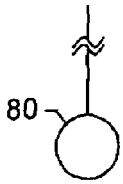
Figure 10:
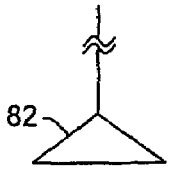
Figure 11:
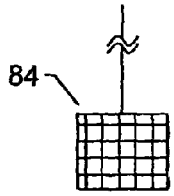

Many "industrial ceilings," such as those found in a retail shopping establishment, contain sub-ceilings that conceal a crawl space. Thus, the invention may be installed out of view by locating it within a sub-ceiling as shown in FIG. 7. The apparatus 70 is installed above a sub-ceiling 72 such that single line 74 protrudes therefrom and attaches to bar 76.

Turning to FIGS. 8–11, several alternative engagement means are illustrated. Thus, depending upon the ultimate needs of a user, clamps 78, hoops 80, hangers 82, or a bag 84 may be employed in lieu of a bar or similar structure.

Various changes in the details and components that have been described may be made by those skilled in the art within the principles and scope of the invention herein described in the specification and defined in the appended claims. Therefore, while the present invention has been shown and described herein in what is believed to be the most practical and preferred embodiments, it is recognized that departures can be made therefrom within the scope of the invention, which is not to be limited to the details disclosed herein but is to be accorded the full scope of the claims so as to embrace any and all equivalent processes and products.

I claim:

1. A retractable hanging apparatus, comprising:

a pair of mounting bracket means, a spring-biased roller assembly mounted for rotation about a longitudinal axis on said pair of mounting bracket means, at least one line connected at a first end in spooling arrangement with said roller assembly, an engagement means disposed at a second end of said at least one line, wherein said engagement means is adapted to releasably engage an article while maintaining said article free from contact with any other structural component of said apparatus, wherein said mounting bracket means are disposed within a housing that at least partially conceals the spring-biased roller assembly, wherein said housing is mounted within a ceiling substructure such that only said at least one line and said engagement means are visible to a user at ground level; and wherein said roller assembly further includes on an outer surface of a pin flange a brake, the brake comprising:

an arm having one or more protrusions at a first end and a hole at a second end, wherein said arm is pivotally attached to said outer surface at the hole and is held in an unengaged position by a magnet; and a roughened surface disposed upon a bracket means, wherein centrifugal force swings the arm free of the magnet such that the protrusions engage the roughened surface, thereby braking radial acceleration of the roller assembly.

2. The apparatus of claim 1, wherein said engagement means is selected from the group consisting of a clamp, hanger, hoop, bar, or bag.

3. The apparatus of claim 1, wherein said at least one line extends through an aperture in said housing.

4. A method of hanging articles, comprising the steps of:

(a) providing a retractable hanging apparatus that includes a pair of mounting bracket means, a spring-biased roller assembly mounted for rotation about a longitudinal axis on said pair of mounting bracket means, at least one line connected at a first end in spooling arrangement with said roller assembly, and an engagement means disposed at a second end of said at least one line, wherein said engagement means is adapted to releasably engage an article while maintaining said article free from contact with any other structural component of said apparatus, wherein said mounting bracket means are disposed within a housing that at least partially conceals the spring-biased roller assembly, wherein said housing is mounted within a ceiling substructure such that only said at least one line and said engagement means are visible to a user at ground level, wherein said roller assembly further includes on an outer surface of a pin flange a brake, the brake comprising:

an arm having one or more protrusions at a first end and a hole at a second end, wherein said arm is pivotally attached to said outer surface at the hole and is held in a unengaged position by a magnet; and a roughened surface disposed upon a bracket means, wherein centrifugal force swings the arm free of the magnet such that the protrusions engage the roughened surface, thereby braking radial acceleration of the roller assembly;

(b) securing or hanging an article to said engagement means;

(c) raising said article by applying a pulling force to said line or engagement means.

5. The method of claim 4, wherein said engagement means is selected from the group consisting of a clamp, hanger, hoop, bar, or bag.

6. The method of claim 4, wherein said at least one line extends through an aperture in said housing.

* * * * *